United States Patent [19]

Nacke

[11] Patent Number: 4,829,807

[45] Date of Patent: May 16, 1989

[54] RUBBER PAD PRESS

[75] Inventor: Erich Nacke, Sevelen, Fed. Rep. of Germany

[73] Assignee: Siempelkamp Pressen Systeme GmbH & Co., Krefeld, Fed. Rep. of Germany

[21] Appl. No.: 223,560

[22] Filed: Jul. 25, 1988

Related U.S. Application Data

[63] Continuation-in-part of Ser. No. 15,701, Feb. 17, 1987, abandoned.

[30] Foreign Application Priority Data

Feb. 22, 1986 [DE] Fed. Rep. of Germany ..... 3605728

[51] Int. Cl.[4] ..... B21D 22/10

[52] U.S. Cl. ..... 72/465; 72/54; 72/57

[58] Field of Search ..... 72/54, 57, 60, 62, 466, 72/465

[56] References Cited

U.S. PATENT DOCUMENTS

| | | | |
|---|---|---|---|
| 2,840,025 | 6/1958 | Dussling | 72/60 |
| 2,966,873 | 1/1961 | Hoffman et al. | 72/465 |
| 3,120,205 | 2/1964 | Pfeiffer et al. | 72/465 |
| 4,111,024 | 9/1978 | Dahlman et al. | 72/465 |
| 4,162,625 | 7/1979 | Simmons | 72/465 |

FOREIGN PATENT DOCUMENTS

| | | | |
|---|---|---|---|
| 3004616 | 11/1982 | Fed. Rep. of Germany . | |
| 875339 | 9/1942 | France | 72/60 |

*Primary Examiner*—David Jones
*Attorney, Agent, or Firm*—Herbert Dubno

[57] ABSTRACT

A press frame has an upper frame member, a lower frame member, a platen having a tool mounted thereon and disposed at the lower frame member, a working piston-and-cylinder unit disposed at the upper frame member and centered on an upright axis, the piston of the working piston-and-cylinder unit being displaceable and formed with a chamber in alignment with the platen and adapted to receive the tool, an elastomeric pad disposed in the chamber for evenly distributing pressing forces acting on a workpiece on the tool upon the supply of a hydraulic medium under pressure to the piston, whereby an outward force from the chamber is applied to the piston, with means forming a ring space between the piston and cylinder of the working unit at least in part peripherally surrounding the chamber, and means for supplying the ring space with the pressurized hydraulic medium, whereby a pressing force is applied to the piston to counterbalance the outward force.

10 Claims, 4 Drawing Sheets

RUBBER PAD PRESS

CROSS REFERENCE TO RELATED APPLICATION

The present application is a continuation-in-part of pending application Ser. No. 015,701, filed Feb. 17, 1987 now abandoned.

FIELD OF THE INVENTION

The present invention relates to a press and, more particularly, to a rubber pad press, i.e. a press in which part of the press force compresses a rubber pad interposed between the source of that force and the workpiece.

BACKGROUND OF THE INVENTION

A known rubber pad press comprises an upper frame member or head, a lower frame member or bed and a working piston-and-cylinder device. The lower frame member and upper frame member are coupled in a press frame by an anchor bolt. The lower frame member carries a platen and a tool mounted on the platen. A receiving chamber formed in a device which supports the chamber and the interior pressing force exerted thereon is located in the upper frame member. The rubber pad is positioned in this receiving chamber.

In a rubber press pad as taught in German Pat. No. 30 04 616 the lower frame member or bed contains the cylinder of the working piston-and-cylinder unit. The piston guided in it carries the platen with the tool. The receiving chamber or casing for the rubber pad is in the upper frame member or head as noted. The device for maintaining the chamber interior pressure during operation of the rubber pad press comprises a binding or rim which surrounds the lower frame member in the vicinity of the receiving chamber. The binding rim forms an additional mechanical structural member which must be assembled with the press and is expensive to manufacture. Also it must be designed to take the highest working pressure of the rubber pad press and it thus must usually be overdimensioned to prevent distortion of the casing. On the other hand a special unit for maintaining the chamber interior pressure is required to guarantee that the casing and the upper frame member will not be damaged by an overload.

OBJECTS OF THE INVENTION

It is an object of the present invention to provide an improved rubber pad press which obviates these drawbacks.

It is also an object of the invention to provide an improved rubber pad press in which no special binding is required so that the structure can withstand the chamber interior pressing force.

It is another object of the invention to provide an improved rubber pad press which has a structure which is self-adjusting to the operating pressure.

SUMMARY OF THE INVENTION

These objects and others which will become more readily apparent hereinafter are attained in accordance with my invention in a rubber press pad comprising an upper frame member, a lower frame member, a working piston-and-cylinder unit, and a platen lifting unit, the lower and upper frame members being combined in a press frame by an anchor bolt. The lower frame member carries a platen driven by the hydraulic lifting unit, with a tool mounted on the platen. A receiving chamber or cavity is formed in the working piston-and-cylinder unit which maintains the chamber interior pressing force and is positioned in the upper frame member and the rubber pad is positioned in the receiving chamber or cavity.

According to the invention the upper frame member has or contains the cylinder of the working piston-and-cylinder unit in which the piston of the piston-and-cylinder unit is movable up and down. Further, the receiving chamber is positioned in the piston or in a piston extension whose outer peripheral surface opposite the upper frame member forms therewith a ring space which is acted on by the hydraulic medium of the working piston-and-cylinder unit so that the chamber interior pressing force is supported by a counterbalancing pressure formed in the ring space and acting on the piston. Advantageously means is provided for preventing rotation of the piston in the cylinder of the working piston-and-cylinder unit.

As in all rubber pad presses from time to time the rubber pad must be replaced. This is made possible according to the present invention when at least one ejecting unit for ejecting the rubber pad from the chamber is provided in the piston. It is understood that the rubber pad usually is held in place by strips or the like fastened beneath it.

The action of the pressure which the piston experiences in the vicinity of the receiving chamber can be varied in regard to its effective range so that an adjustment to different operating conditions can be made. The end of the piston and/or the piston extension closest the tool can have an axially adjustable seal on its outer periphery for this purpose.

As far as the invention is concerned the shape of the piston is not a key factor. A desirable example of my invention which provides a comparatively large rubber pad is particularly characterized by the piston together with the piston extension and correspondingly the cylinder having a stepped axial cross section. The receiving chamber is located in the region of the piston having the larger diameter. The ring space surrounds the region of the piston having the large diameter and is extended into a transitional region between the region of larger diameter and a region of a smaller diameter.

The invention is based on the discovery that in a rubber press pad the hydraulic medium used to lift the platen can fulfill an additional function, namely it can maintain the receiving chamber internal pressing force when, as described, a ring space is provided and the hydraulic medium of the working piston-and-cylinder unit is fed into the ring space during operation of the rubber pad press. A balancing of the pad pressure by the working pressure is thus effected. The chamber interior pressing force is usually taken up by the upper frame member being acted on by the hydraulic medium. By adjustment of the seal which surrounds the piston and/or the piston extension on the outer periphery of the piston, different operating conditions can be accommodated. A relatively thin walled piston structure can be used for the piston in the vicinity of the receiving chamber.

BRIEF DESCRIPTION OF THE DRAWING

The above and other objects, features and advantages of my invention will become more readily apparent from the following description, reference being made to the accompanying highly diagrammatic drawing in which.

SPECIFIC DESCRIPTION

Figure 2:
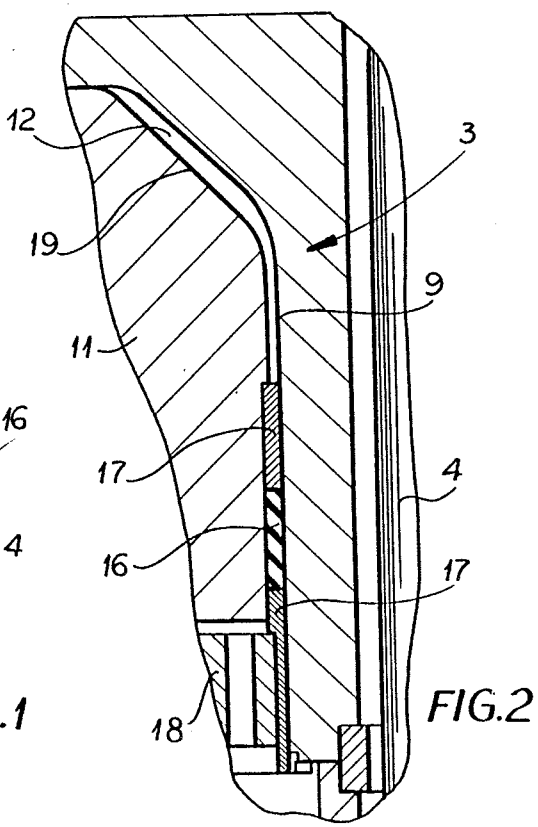
FIG. 2 is a detailed view of the region II of FIG. 1.
Figure 1:
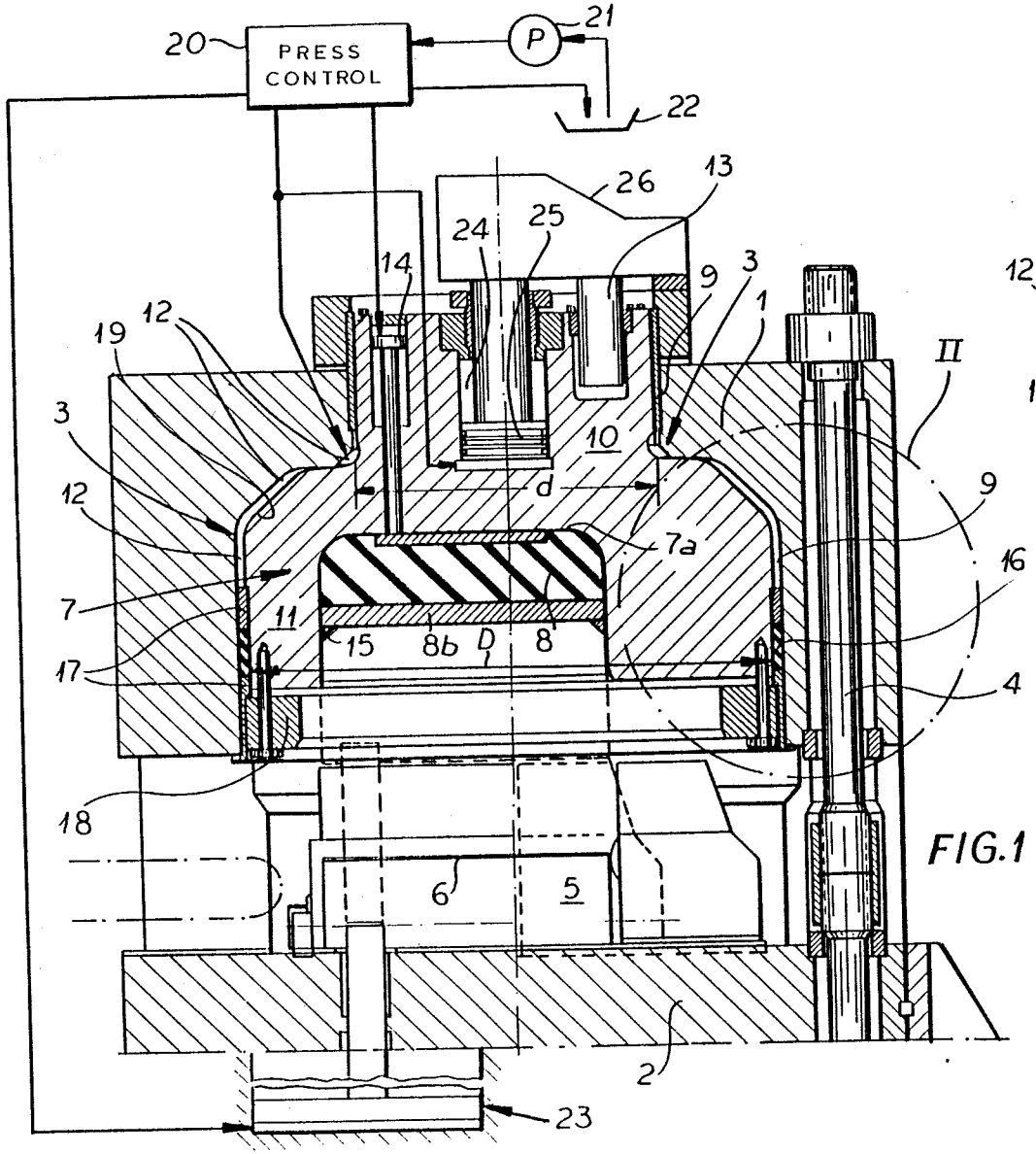
FIG. 1 is an axial cross sectional view of a rubber pad press according to my invention.

The rubber pad press shown in the drawing comprises an upper frame member 1, a lower frame member 2, a working piston-and-cylinder unit 3 centered on an upright axis, and a platen lifting unit 23. The upper frame member 1 and the lower frame member 2 are joined together in a press frame by an anchor bolt 4. The lower frame member 2 carries a platen 5 with a tool 6 mounted thereon, the platen 5 being driven by the hydraulic lifting unit 23 also provided on the lower frame member 2. The upper frame member 1 has a receiving chamber 7*a* formed in a casing 7. The rubber pad 8 is placed in this receiving chamber 7*a*.

The upper frame member 1 contains the cylinder 9 of the working cylinder piston unit 3 in which the piston 10 of the working piston-and-cylinder unit 3 is movable up and down.

The casing 7 for the rubber pad 8 is formed in a piston extension 11 of the piston 10, the piston 10 also being formed with an axially disposed cylinder 24 receiving a piston 25 fixed to the upper frame member 1 by a bridge 26.

Figure 3:
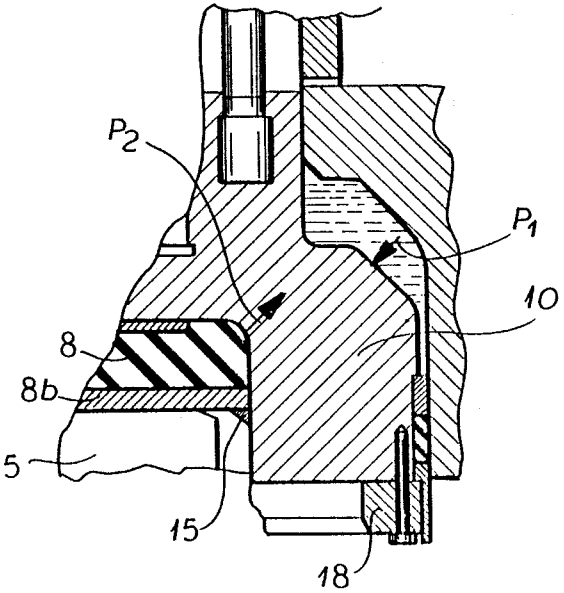
FIG. 3 is a fragmentary section corresponding to FIG. 1 showing the piston advanced and the rubber pad compressed by engagement with the workpiece.

The outer circumferential surface of the piston 10 or piston extension 11 is bounded by a ring space 12 opposite the upper frame member 1 which is acted on by the same hydraulic medium which supplies the platen lifting unit 23 and the cylinder 24, for supporting the chamber internal pressing force, as seen by the balance between the pressures $P_1$ and $P_2$ in FIG. 3 (representing the working position of the piston 10).

The piston 10 of the working piston-and-cylinder unit 3 is guided nonrotatably in the cylinder 9 by an axially offset bolt 13 fixed to the upper frame member 1 by the bridge 26 and extending into the piston 10.

Usually an ejecting piston-and-cylinder unit 14 for ejecting the rubber pad 8 from the casing 7 is provided in the piston 10 which is used when the rubber pad must be exchanged. The rubber pad 8 backed by a steel plate 8*a*, is usually retained underneath by strips 15 past which the pad 8 and its facing steel plate 8*b* can be forced.

The piston 10 or the piston extension 11 has a seal 16 at its tool end on its outer periphery which seals the ring space 12. The position of the seal 16 is highly adjustable in the axial direction by a pair of shim members or spacers 17 and is usually fixed in position by a holding ring 18. Since the seal 16 is highly adjustable, an adjustment to different operating pressures can be made.

The piston 10 together with its piston extension 11 and correspondingly the cylinder 9 have a stepped axial cross section. The casing 7 is positioned in a region of a larger diameter D of the piston 10 or cylinder 9 and the ring space 12 surrounds substantially the region of the larger diameter D and is extended between the region of larger diameter D and a region of smaller diameter d.

Figure 4:
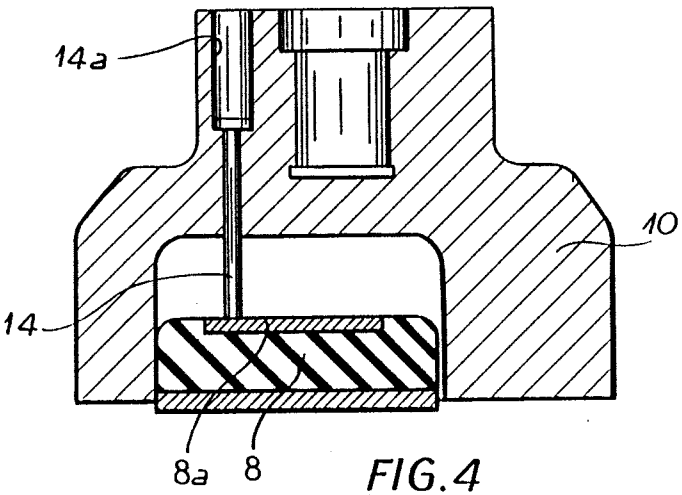
FIG. 4 is a section through this piston showing the ejection of the pad.

The hydraulic fluid is fed to ring space 12, cylinder 24, and lifting unit 23 by the press control 20 from a pump 21 and reservoir 22. For ejection of the pad 8 (see FIG. 4) the control 20 can supply the hydraulic fluid under pressure to the cylinder 14*a* of piston 14.

Figure 5:
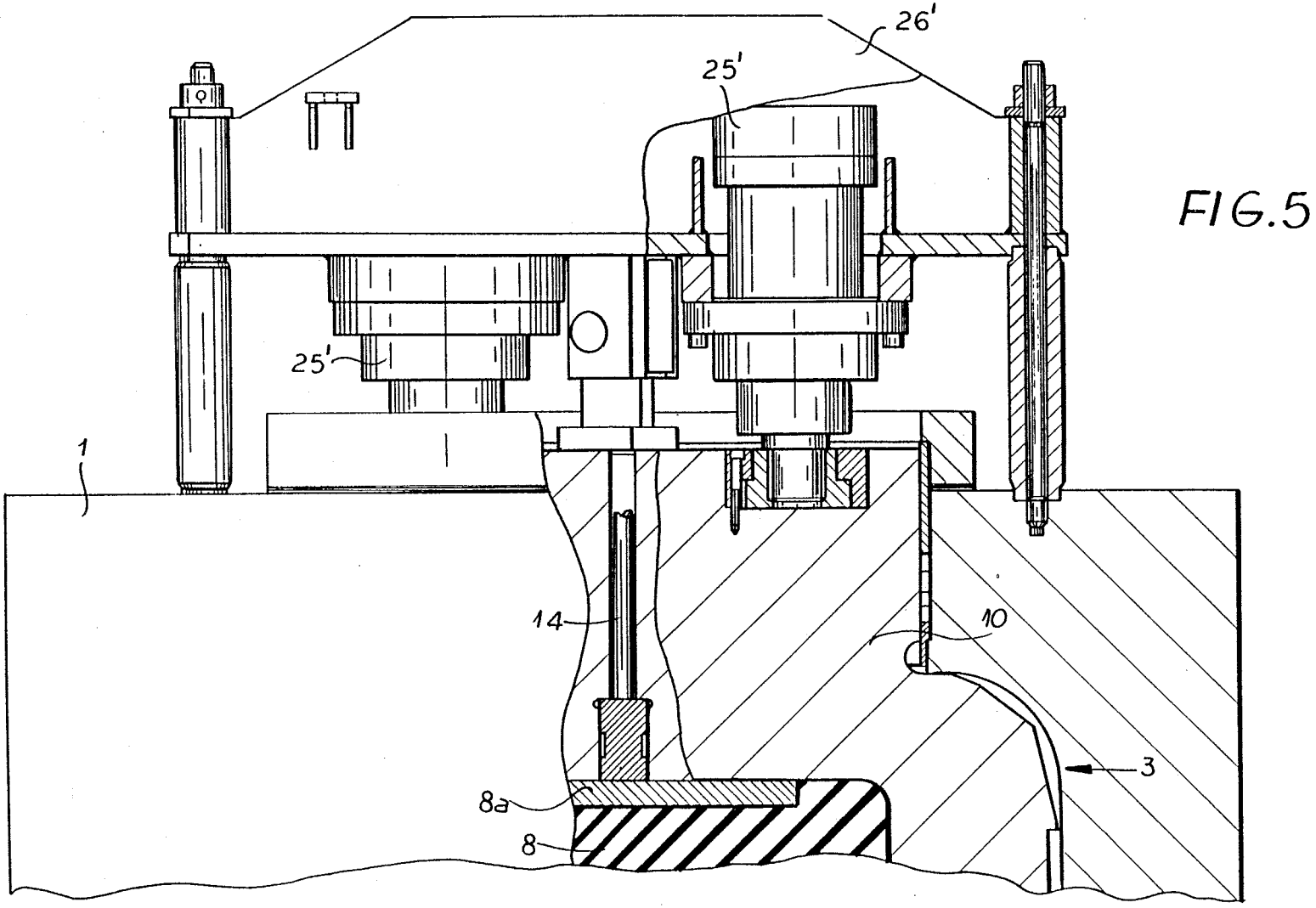
FIG. 5 is a sectional view similar to that of FIG. 1 showing another embodiment of the invention.
Figure 6:
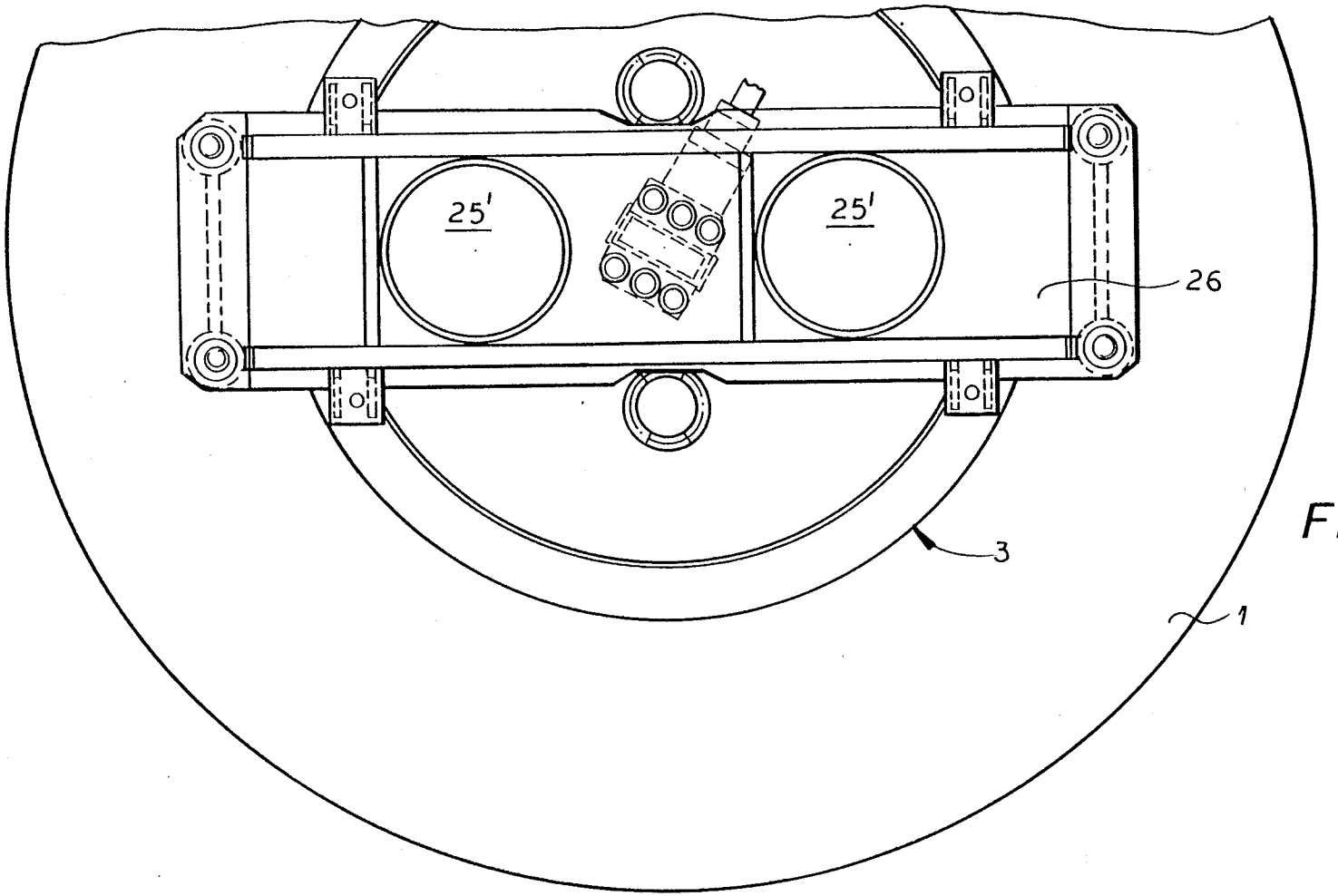
FIG. 6 is a top plan view of FIG. 5.

Another embodiment of the invention is illustrated in FIGS. 5 and 6 in which the piston 25 is replaced by a pair of pistons 25' arranged diametrically opposite one another offset from the upright axis and fixed to the upper frame member 1 by a bridge 26', so that the piston 10 is held nonrotatably in cylinder 9, thereby eliminating the need for the bolt 13.

I claim:

1. An elastomeric pad press having a press frame comprising:

an upper frame member;

a lower frame member;

a platen having a tool mounted thereon and disposed at said lower frame member;

a working piston-and-cylinder unit provided at said upper frame member and centered on an upright axis, the piston of said working piston-and-cylinder unit being displaceable and formed with a chamber in alignment with said platen an adapted to receive said tool;

an elastomeric pad disposed in said chamber for evenly distributing pressing forces acting on a workpiece on said tool upon the supply of a hydraulic medium under pressure to said piston, whereby an outward force from said chamber is applied to said piston;

means forming a ring space between the piston and cylinder of said working unit at least in part peripherally surrounding said chamber; and means for supplying said ring space with the pressurized hydraulic medium, whereby a pressing force is applied to said piston to counterbalance said outward force.

2. The press defined in claim 1, further comprising guide means disposed at said upper frame member in engagement with said piston offset from the axis thereof for the nonrotational guidance of said piston during displacement thereof.

3. The press defined in claim 1, further comprising at least one ejection means in said piston and engageable with said elastomeric pad for ejecting said pad from said chamber.

4. The press defined in claim 1, further comprising an annular seal provided in said ring space at an end of said piston closest to said lower frame member and bearing against a peripheral wall of said piston and an inner wall of said cylinder for forming a fluid-tight compartment defined by said ring space, said seal being axially adjustable for providing different operating pressures in said ring space.

5. The press defined in claim 1 wherein said piston-and-cylinder unit has a stepped axial cross section in which substantially half the axial length thereof has a diameter which is greater than the diameter of the remaining half axial length, and said ring space extends axially over a transitional portion of said piston-and-cylinder unit between the half of greater diameter and the remaining half, the half of greater diameter being closest to said lower frame member.

6. The press defined in claim 1, further comprising at least one second piston-and-cylinder unit disposed at said upper frame member and bearing on said first mentioned piston, and means for supplying said pressurized medium to said second unit.

7. The press defined in claim 6 wherein said second piston-and-cylinder unit is centered on said upright axis.

8. The press defined in claim 6 wherein a pair of said second piston-and-cylinder units are disposed at said upper frame member and bear on said first piston offset from the axis thereof.

9. The press defined in claim 8 wherein each unit of said pair of said second units is disposed diametrically opposite the other on a diameter passing through said upright axis.

10. The press defined in claim 9 wherein each unit is equidistant from said upright axis.

* * * * *